United States Patent [19]

Hefele

[11] Patent Number: 4,655,868

[45] Date of Patent: Apr. 7, 1987

[54] TOP CLOTH FOR ARTICLES OF CLOTHING AS WELL AS A MANUFACTURING PROCESS AND TRANSFER UNIT FOR IT

[75] Inventor: Josef Hefele, Gräfelfing, Fed. Rep. of Germany

[73] Assignee: Kuener Textilwerke GmbH, Munich, Fed. Rep. of Germany

[21] Appl. No.: 644,025

[22] Filed: Aug. 24, 1984

[30] Foreign Application Priority Data

Aug. 26, 1983 [DE] Fed. Rep. of Germany ..... 3330866

[51] Int. Cl.[4] ..... B32B 31/00; B32B 7/14; B32B 7/06; B44C 1/16

[52] U.S. Cl. ..... 156/238; 156/249; 156/246; 156/247; 156/267; 156/291; 156/344; 428/202

[58] Field of Search ..... 156/230, 231, 234, 241, 156/238, 239, 240, 247, 249, 267, 277, 291, 292, 246, 300, 344; 427/211, 414; 118/246, 212; 428/414, 201, 200, 202, 904, 41, 241

[56] References Cited

U.S. PATENT DOCUMENTS

| | | | |
|---|---|---|---|
| 3,589,962 | 7/1971 | Bonjour | 156/233 |
| 3,741,786 | 6/1973 | Torrey | 156/234 |
| 3,922,435 | 11/1975 | Asnes | 428/914 |
| 3,936,570 | 2/1976 | Iwata | 156/234 |
| 4,041,204 | 8/1977 | Hepher et al. | 156/240 |
| 4,076,879 | 2/1978 | Suskind et al. | 428/904 |
| 4,141,313 | 2/1979 | Hefele | 118/212 |
| 4,183,978 | 1/1980 | Hefele | 428/201 |
| 4,302,500 | 11/1981 | Flora | 156/230 |
| 4,323,611 | 4/1982 | Pöll | 428/241 |
| 4,326,004 | 4/1982 | Hefele | 428/201 |

FOREIGN PATENT DOCUMENTS

| | | | |
|---|---|---|---|
| 48101 | 6/1976 | Japan | 156/240 |
| 235878 | 11/1985 | Japan | 156/235 |

*Primary Examiner*—Michael Wityshyn
*Assistant Examiner*—Louis Felasio
*Attorney, Agent, or Firm*—Charles F. Meroni, Jr.

[57] ABSTRACT

The invention concerns a top cloth, especially a top cloth cut for clothes, which top cloth or cut is coated on one side with a patterned coating serving to stabilize it. Inventively this coating comprises a lower adhesive layer (2) of patterned heat-sealable plastics elements which are not interconnected and which adhere to the back of said top cloth or cut (1), and an upper covering layer (3) of non-hot sealable or substantially non-hot sealable material. The covering layer can extend substantially or fairly continuously, i.e. pattern-free, over the lower patterned adhesive layer and optionally beyond it and can in its areas between the pattern points of the lower layer not adhere to the top cloth or only slightly adhere thereto, while being easily wiped off. But it can also be directly patterned and congruent with the adhesive pattern beneath it. The invention concerns a process for the manufacture of such a top cloth and a transfer unit for implementing said process.

17 Claims, 4 Drawing Figures

TOP CLOTH FOR ARTICLES OF CLOTHING AS WELL AS A MANUFACTURING PROCESS AND TRANSFER UNIT FOR IT

The invention concerns a top cloth, especially top cloth cut, for articles of clothing with a one-sided patterned coating for its stabilization. Such stabilized top cloths or top cloth cuts are used for smoothing or keeping smooth certain parts of articles of clothing, such as frontal areas, sleeves, collars, plates and the like.

For smoothing or keeping smooth clothes, today the socalled fixing linings are used almost exclusively. They consist of a fabric, a fleece, knitwear or woven textile and are coated with hot-sealable adhesives in patterend form. The fixing linings are affixed using fixing presses on the cuttings of the top cloth. Due to the lining, the article of clothing is given a smooth pleasing appearance which also remains to a large extent under different climatic conditions. The article seldom needs to be ironed to look good, shapely and smooth.

Since recently ever-increasing optimal softness has been demanded from the article, but without losing the effect of smoothness, ever lighter linings are being processed which have scarcely any handle. The patterned adhesive coating of especially light and thin lining materials, in view of the demand for the attainment of adequate connection with the top cloth, tends to penetrate through the lining. During fixing in the fixing press the linings remain hanging together with the affixed top shell on the top cloth of the press.In the case of the widely practised sandwich fixing in which two identical top cloth cuts are fixed in one working process with interposed linings in common, there is a so-called refastening process between the rear sides of the lining materials, i.e. the two linings tend to stick on their superimposed rear sides. Other problems also arise such as for example the agglutination of the backing materials with the back of the lining during the ironing of the article in the final processing stage. It is true that these defects can be largely eliminated by reducing the amount of adhesive; but then in many cases the adhesion is no longer sufficient.

To reduce the reaction tendency an adhesive coating on linings has become known in which the patterned arrangement of the adhesives has a double-layered composition. The lower layer resting directly on the lining has a lower thermoplastic flow than the actual adhesive layer placed upon it(DE-AS-25 36 911). Using such a double coating the reaction tendency and the refastening are reduced, but are not eliminated in full.

At all events however the affixing of fixing linings produces not only a smoothing effect but also a clear tautening of the handle of the article in the fixed area, a phenomenon which in the fashion trends today is increasingly undesirable. To do justice to the trend of fashion, recently there has been a return to the classical lining processing, in which the linings are no longer ironed on, but are sewn in as in the past. However this means accepting higher labour costs, since the old classical sewing of the linings is considerably more costly for the production of an article of clothing which looks as smooth as a front-fused article.

Recently processes have become known in which both the classical as well as the front fused linings are replaced by patterned plastic substances. In this working technology, the top cloth cuts during the curing process tend to undergo yellowing and changes in color tones as well as shrinkage thereby reducing the volume of the top cloth, and the use of this printing technique is substantially limited solely to voluminous top cloths.

Equally known is a process in which extruded adhesive meshes are ironed on to the top cloth, having a double-layered design. On the side facing the top cloth the meshes become adhesively active under the influence of pressure and heat, but not on the other side. Here too there is a strong tautening of the handle and its use is also limited voluminous top cloths. When using less voluminous top cloths, it has been found that the mesh structure is discernible on the top cloth side.

To be able to process even thin top cloths without loss of volume using a printing technology and to achieve a more textile handle, it is known from DE-A1-30 14 656 that on the rear side of top cloth cuts, thermosetting, high-viscosity dispersion pastes can be applied in pattern form which substantially only adhere on the top cloth rear side and do not penetrate into the top cloth. The patterned imprint serves as the bonding substance for flocks which are electrostatically injected. With this flocking process, after a two-stage curing a composite of top cloth and flock layers is obtained which are soft, supple and full-bodied and simultaneously cause the desired smoothing. However it is not possible to completely eliminate the tautening of the handle. In addition, the two named printing technologies require high investment costs, and demand from the garment maker, knowledge of working techniques which are not part of his profession.

In this specification the terms "patterned coating" or "patterned elements" are used to mean a plurality of substantially coplanar elements arranged in a pattern, such as a raster-form.

My invention is therefore based on the object of forming a top cloth or top cloth cut with patterned coating so that when using it, clothes are produced which, without the use of specially inserted stiffening linings in certain areas, have the desired smoothness of an article with lining, yet in the handle (the feeling of softness and the full-bodied quality when touched with the hand) have about the same softness as an article with the classically inserted lining. The invention is further based on the object of creating a process for the production of such a top cloth and the necessary aids to this end.

The first named object is inventively achieved by the coating of the top cloth being provided with a patterened hot-sealable plastic-containing lower adhesive layer that is adhered to the top cloth which layer is not interconnected in the plane and a top layer adhering to said lower layer, which top layer is of non-hot sealable or substantially non-hot sealable material. By a hot sealable substance a substance is defined here which in conditions such as those during ironing or affixing of such a substance on a substrate, e.g. a top cloth, and also under the given pressure and temperature conditions (pressures from 50 to 500 $p/cm^2 = cN/cm^2$, preferably 200 to 400 $p/cm^2$ and temperatures from 100° to 180° C., preferably 120° to 170° C.) become adhesively active, i.e. in these conditions it can adhere to the objects or materials pressed upon it, and wherein this adhesive activity can again be obtained in such conditions, and thus full chemical curing of the adhesives does not occur during ironing or fixing.

By non-hot sealable or substantially non-hot sealable materials, we mean all materials or raw materials which under ironing or fixing conditions are not or do not become adhesively active, and thus in these conditions are not hot-sealable.

A special advantage is the fact that the inventive top cloth also remains stable in dimensions even under changing climatic conditions, whereas uncoated cuttings often show a tendency to extend, especially on suspended articles of clothing. For articles with top cloths as in the invention, in which stiffening linings have been inserted in the classical way, this leads to the fact that the top cloth does not undulate at the seams and thus the article maintains its smooth state, which with articles of a non-inventive top cloth and with stiffeners classically inserted is seldom the case.

The invention top cloth can be used for keeping smooth or stabilizing not only frontal areas but also seams, collars, lapels, tabs or the like of outerwear, where the article is to have a smooth fit and yet nevertheless a soft handle. It can also be used universally for blouses regardless of the color design of the top cloth.

Expediently with the invention top cloth the top layer extends in the same pattern as the lower adhesive layer, while both layers are placed with their patterns precisely matching. Such a top cloth is distinguished by its special softness and air permeability, so that when using it a good-breathing article is obtained.

A further embodiment of the invention top cloth may also by expedient in which the covering layer extends continuously without pattern over the lower patterned adhesive layer below it and extends beyond the latter. The covering layer may not abut the top cloth substantially or may only adhere to it slightly in its areas between the pattern points of the adhesive layer. The release of the covering layer from the top cloth should be made possible in the intermediate areas by mechanical influences, such as beating, brushing, wiping or the like.

The patterned adhesive layer may consist of hot melt adhesive (hot sealable) material, e.g. on the basis of copolyamides, copolyesters, and/or low pressure polyethylenes or the like which are applied as powder or as paste and can be formed therefrom, whereas the top covering layer acting as the barrier agianst reactivation of the lower adhesive layer consists of material which is substantially non-adhesive up to 180° C. and may e.g. be formed from an aqueous pasty substance which can contain finely dispersed plastics, mineral fillers or mixtures thereof.

The invention further concerns a process for the production of the inventive top cloth. In this process firstly on a flat substrate the two layers with which the top cloth is to be coated are moved to each other in the reverse position, i.e. the non-hot sealable covering layer on the support layer and above the latter the hot sealable adhesive layer, whereupon the layer carrier (normally a flat substrate) is placed as a transfer unit with its patterned adhesive layer downwards on the top cloth, and the adhesive layer is made to adhere firmly by using pressure and heat on the top cloth. The continuous layer 6 after being transferred to the top cloth is brekable and detachable in area 7, where it is not located over the rasters of the adhesive layer. The carrier is now removed from the transferred coating. The basic layer now forming the covering layer on the top cloth can be made to drop off the top cloth by mechanical means such as wiping, beating, brushing or the like in its areas adhering on the pattern of the adhesive layer. To facilitate the removal of the carrier layer from the basic layer after its application on said top cloth, before the application of the basic layer on the carrier layer, an anti-adhesive agent may expediently be applied on said carrier layer. But it is also possible to coordinate the adhesion of the basic layer on the carrier and on the adhesive layer so well that the basic layer only detaches itself from the layer carrier in its areas sitting on said patterned adhesive layer and that otherwise it is removed with the layer carrier in the residual areas between the pattern of the adhesive layer. In this case the beating, wiping and the brushing can be omitted.

The invention also concerns the above transfer unit for effecting the named process, consisting of a layer carrier, a unilaterally applied non-hot sealable or substantially non-hot sealable base layer applied on said layer carrier, while the basic layer extends continuously, i.e. unpatterned, over the support, having on said basic layer a patterned hot-sealable adhesive layer. It is an advantage if the baselayer forming the later covering layer on the carrier layer, when being removed from the layer carrier after the application of the two layers on the top cloth, is partly withdrawn, i.e. with the areas between the pattern, in so far as it is ensured that the patterns of the adhesive layer remain fully covered by the residual portion of the basic layer, to avoid any agglutination of the coated top cloth and/or cutting with the other fabric areas or with other substances.

The drawings show an especially expedient embodiment of the inventive top cloth and of the inventive process for its production, which will be described in more detail below:

Figure 1:
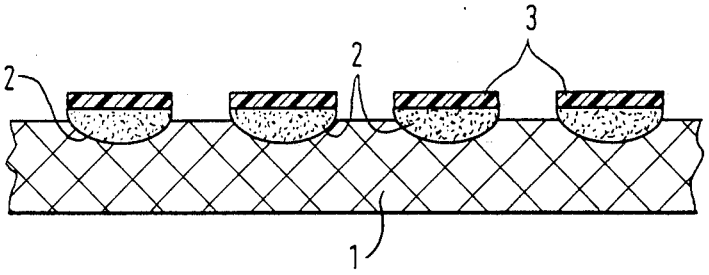
FIG. 1 shows a fragmentary enlarged section of an embodiment of my inventive top cloth.
Figure 3:
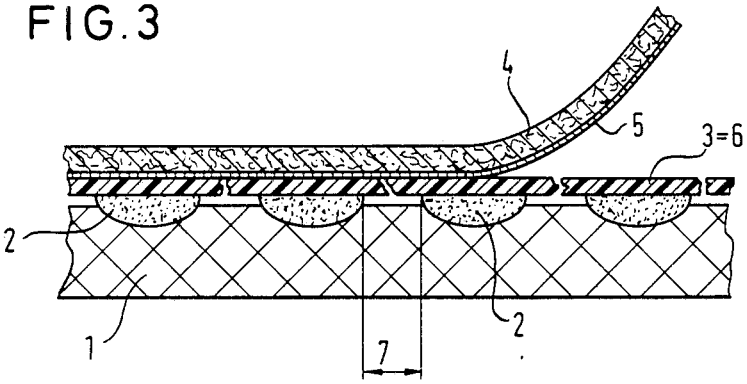
Figure 4:
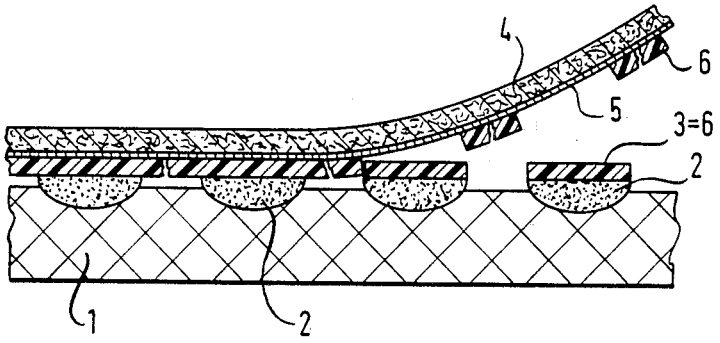

FIG. 3 and 4 disclose enlarged fragmentary views of the coating of the top cloth as in the embodiment of FIG. 1. FIG. 3 shows the later wiping of the intermediate areas between the adhesive pattern, but FIG. 4 does not.

In the embodiment shown in FIG. 1, the top cloth cut 1 is covered with a hot-sealable adhesive layer 2 on a plastic basis in polka dot pattern. The pattern dots of this layer are covered by superimposed dots of a covering layer 3 made of non-hot sealable material. On the dots 2 placed on the top cloth 1 there is a congruent layer 3. The dot pattern may have rod form. By use of pressure and heat the dots of the lower adhesive layer 2 are made to adhere on the top cloth cut 1 and on the dots of the superimposed covering layer 3.

Figure 2:
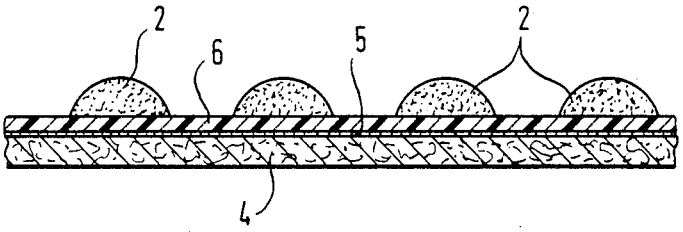
FIG. 2 is an enlarged fragmentary view of a transfer unit for the application of the inventive coating as in the embodiment of FIG. 1.

FIG. 2 shows a transfer unit for the application of the two adjacent layers 2 and 3 on the top cloth 1. This transfer unit consists of a layer oarrier or substrate 4 in the form of a cutting made of sulfate paper or the like on which an anti-adhesive layer 5 is applied. On this anti-adhesive layer there is a continuously extending, i.e. non-patterend, base layer 6 stretching over the substrate 4, and made of non-heat sealable or substantially non-heat sealable material. To be able to obtain this flat base layer in the identical layer thickness, it can for example be printed on as paste or powder using a patterned film screen and then be coated smooth with a flat rubber lip, a steel blade or a rotary or fixed smoothing roller. The closed fabric base layer thus produced is then dried to form a slightly porous and rough film, which owing to its nature and its flatness adheres well enough on the substrate 4 and/or on the anti-adhesive layer 5 applied thereon.

On this flat base layer 6 the hot sealable adhesive layer 2 is applied in polka dot pattern. It can also be printed on as paste or powder, e.g. using a film screen of e.g. 25 mesh or of a similar mesh.

The transfer unit shown in FIG. 2 of the embodiment can be turned through 180° and placed with its punctiform adhesive layer 2 downwards on the top cloth cut 1 which is to be coated, after which, by the use of pressure and heat, the dots of the adhesive layer are made to adhere on the top cloth cut 1. Then the substrate 4 with its anti-adhesive layer 5 can be removed from the base layer 6 forming the covering layer on the top cloth cut, so that now the dots of the adhesive layer 2 and above them the still fairly continuous unpatterned base layer 6 forming the covering layer are disposed on the top cloth cut (see FIG. 3). The base layer 6 consisting of substantially non-hot sealable material is made so that it can be caused to drop off the top cloth 1 in its areas 7 between the dots of adhesive layer 2, e.g. by mechanical influences such as wiping, beating, brushing or the like, so that it remains on the subordinated dots of the adhesive layer 2 only in the form of the punctiform covering layer shown in FIG. 1. Then the treatment in the processing of the top cloth in the usual course of garment production suffices to effect a thorough removal of the non-anchored intermediate areas of the covering and/or base layer. But it is also possible to adjust the adhesion of the base layer directly so that it is detached from the carrier only in its areas which rest in patterned form on the adhesive layer while the intermediate areas remain suspended on said carrier (see FIG. 4).

The base layer 6 forming the covering layer 3 can consist of material which is substantially non-adhesive at temperatures up to 180° C., and which is applied as powder or as a paste, e.g. a pasty substance of finely dispersed plastic filler which is dispersable in water and is non-adhesive up to 180° C., made of mineral fillers, mixtures thereof or the like. The plastic can be a PVC powder, and can be applied in aqueous dispersion in combination with a thickener and a fatty acid or its salt. Advantageously the dispersion contains further silicons which should preferably be cross-linkable. As the thickener, a thickener on the basis of polymer acrylic acids or their salts can be used. But the dispersion can also contain instead or additionally starch, carboxymethylcellulose, hydroxyethycellulose, gelatine or mixtures thereof as the thickener.

If the covering or base layer consists of or contains mineral fillers, pulverized silicic acid, talcum powder, calcium carbonate powder or the like can be used as the fillers. Lastly pastes can also be used whose volatile parts contain solvents. Thus e.g. cross-linkable polyurethane dissolved in a solvent or cross-linkable polyacrylate dispersed in water mixed with mineral fillers or fillers on a plastic basis as well as fatty acids or their salts and cross-linkable silicons can be used.

As the layer carrier or substrate for the transfer coating, primarily use is made of sulfate paper with an anti-adhesive coat (silicon paper). But instead of silicon paper, sheets, for example viscose foil sheets are usable when thin, which may also have an anti-adhesive layer of silicon.

Flocking materials such as those described in DE-OS No. 3014 656 are not considered for the formation of the non- or substantially non-hot sealable covering or base layer, or are only considered under certain conditions.

EXAMPLE

Sulfate paper siliconized on one side, of 50 g/m$^2$ in weight, is printed with paste using an 11 mesh film screen in patterned form. This paste has the following composition in parts by weight(PW):

- 20 PW suspension PVC(K value under DIN 53726 about 65) grain size less than 60 microns more than 97%
- 6 PW behenic acid
- 10 PW ammoniacal alkaline aqueous solution of 10% polyacrylic acid(pH=11)
- 30 PW aqueous polymethacrylic acid dispersion 30%
- 7.2 PW silicon finish VP 1419 E from Wacker-Chemie GmbH. Munich(FRG)
- 2.8 silicon cross-linker VP 1420 from Wacker-Chemie GmbH, Munich(FRG)
- 84 PW water The pasty applied printing is smoothly applied over the entire width of the paper by a rotating and a fixed smoothing roller to form a flat base layer. Then the paper sheet passes via a dryer, where the base layer is dried at about 150° C. and is cross-linked. The dry coating weight of the base layer is between 15 and 20 g/m$^2$.

In a second run the paper sheet is coated in 25 dot pattern with a paste which has the following composition in parts by weight(PW):

- 36 PW copolyamide powder 0–80 microns
- 6 PW stearin
- 14 PW suspension PVC (K value under DIN 53726 about 65) grain size less than 60 microns above 97%
- 14 PW ammoniacal alkaline solution of 10% polyacrylic acid in water
- 9 PW acronal 160 D(from BASF AG, FRG)(=40% aqueous dispersion on the basis of a non-cross-linked acrylic acid ester-acryl nitrile copolymerizate with high oil stability, hard film formation and good thermal stability up to about 60° C.
- 72 PW water.

The patterned coating (adhesive layer) is also dried and then sintered. The dryer setting is 140° C. The applied weight of the adhesive coating is 15 g dry weight/m$^2$.

Cuttings are cut out of the paper sheet thus coated. The cuts are placed with the adhesive coat first on the back of the top cloth cuts. In a fixing press the coating is affixed at 165° C. top plate temperature, 100° C. lower plate temperature, 15 seconds fixing time and 300 p/m$^2$ on the top cloth cut. After opening the fixing press and cooling the ironed composite, the siliconized sulfate paper is removed. The top cloth now allows the base layer forming the covering layer on it in the areas adhering on the pattern of the adhesive layer to be easily wiped from the top cloth by using a cloth or a clothes brush. There remains an exact patterned double coating on the back of the top cloth, which shows no more adhesion when a lining material is ironed onto the top cloth. Even in the case of ironing folds in which the coated sides come to rest on each other, no more adhesion is found between the sides. The folded part opens by itself after ironing.

To avoid the necessity to wipe off the areas of the base layer between the patterned dots of the adhesive layer after the removal of the carrier from the top cloth, a paste can be applied which forms a base layer, whose removal is done as in FIG. 4. The paste composition is as follows:

20 PW suspension PVC (K value under DIN 53726 about 65), grain size less than 60 microns above 97%

3 PW magnesium stearate powder most finely dispersed 10.4 PW rohagit S from Röhm GmbH, Darmstadt FRG(=carboxyl group-containing extremely low viscosity acryl resin(acidic number 410 to 430 mg KOH/g, viscosity about 70 mPa.s(milli.Pascale.s) in a 3% aqueous solution adjusted to pH 9 using ammonia).

4 PW concentrated ammonia

30 PW aqueous polymethylacrylic acid dispersion 30%

5 PW silicon finish 1419 E from Wacker-Chemie, Munich FRG 1.6 PW silicon cross-linker VP 1420 from Wacker-Chemie GmbH, Munich FRG.

84 PW water

The cuts of the top cloth thus treated pass through the make-up in the conventional way and are processed into finished articles. For example the top cloth cut can be wholly provided with the inventive pattern coating and the insertion of a fixing lining in the garment is then unnnecessary. But it is also possible to provide the inventive coating only on the seam, revers, collar or lapel areas of a garment to achieve the desired stabilization, without having to accept any clear hardening of the handle. For example if the front of a jacket is provided in the button hole area with this inventive coating, in addition a conventional lining not equipped with hot seal adhesive can be sewn in, without having to fear an undulating deformed formation of the buttonhole edge. In this way the old and conventional modus operandi can be revived without any need for the high labour costs to remove the undulations.

I claim:

1. Process for the manufacture of a top cloth, especially of a top cloth having a one-sided patterned coating for its stabilization, wherein the coating consists of a lower adhesive layer of patterned, hot-sealable plastics elements which are not interconnected in the plane of the adhesive layer and which adhere to the rear of the top cloth and an upper covering layer adhering to the adhesive layer wherein said upper covering layer consists of a non-hot-sealable material, comprising the steps of covering a layer carrier, e.g. siliconized paper on its substrate side with a continuous, patternless base layer extending over this substrate side and which layer carrier is adhered only slightly thereto and consists of substantially non-hot-sealable material, in that then a patterned adhesive layer of hot-sealable plastic is applied thereon, the thus coated layer carrier being applied as a transfer unit with its raster patterned adhesive layer downwards on the rear of said top cloth, while using pressure and heat to soften the adhesive layer and to affix it securely on said top cloth, withdrawing the layer from the base layer forming the covering layer on the top cloth in its areas projecting in patterned form on the adhesive layer, and the continuous layer after being transferred to the top cloth being broken and detached in those areas where it is not located over the raster of the adhesive layer from the top cloth with sharp contours to form a raster shaped covering layer whose raster is seated exactly on the raster of said adhesive layer.

2. Process as in claim 1, wherein before the application of the base layer an anti-adhesive agent is applied on the layer carrier.

3. Process as in claim 1, wherein the base layer is produced on said layer carrier by applying a patterned print of the material forming the base layer, e.g. with the aid of a printing screen, and then smoothing said patterned print into a continuous, unpatterned, thin layer.

4. Process as in claim 1, wherein the base layer is applied in a flow-capable or pasty state and is solidified before the application of the adhesive layer.

5. Process as in claim 1, wherein the patterned adhesive layer is applied in the paste- or powder printing process as a paste or a powder.

6. Process for the manufacture of a top cloth, comprising the steps of covering a layer carrier, e.g. siliconized paper, on one substrate side with a continuous, patternless base layer extending over this substrate side and which layer carrier is adhered only slightly thereto, which base layer later forms on the top cloth to be coated its covering layer and consists of substantially non-hot-sealable material, in that then a raster patterned adhesive layer of hot-sealable plastic is applied thereon, the thus coated layer-carrier being applied as a transfer unit with its patterned adhesive layer downwards on the rear of said top cloth, while using pressure and heat to soften the adhesive layer and to affix it securely on said top cloth, withdrawing the layer carrier from the base layer now forming the covering layer on the top cloth in its areas projecting in patterned form on the adhesive layer, and the continuous layer after being transferred to the top cloth is broken and detached in those areas where it is not located over the raster of the adhesive layer from the top cloth with sharp contours to form a raster shaped covering layer whose raster is seated exactly on the raster of said adhesive layer.

7. The process of claim 6 further characterized by the further step of permitting the base layer to remain adhered to the layer carrier in areas between the adhesive layer on the pattern.

8. Process of manufacture of a top cloth as defined in claim 6, the further step of forming said covering layer (3) so that it extends substantially or fairly continuously, i.e. without pattern, over the patterned adhesive layer (2) below it, and in its areas between the pattern points of the lower layer so that it does not substantially adhere to top cloth (1) or does so adhere only slightly.

9. Process of manufacture of a top cloth as defined in claim 8, the step of forming the covering layer (3) so that it is easily detachable in its areas (7) not adhering or only adhering slightly to said top cloth (1) between the pattern points, by mechanical influence such as beating, brushing, wiping, or the like from said top cloth.

10. Process of manufacture of a top cloth as defined in claim 6, the further step of the patterned lower adhesive layer (2) consisting of a hot melt adhesive (not sealable) material which is applied as a paste or a powder and is formed therefrom.

11. Process of manufacture of a top cloth as defined in claim 10, the step of forming the hot melt adhesive (hot sealable) material of the lower adhesive layer (2) of copolyamides, copolyesters, or low pressure polyethylenes.

12. Process of manufacture of a top cloth as defined in claim 6, the step of manufacturing the upper covering layer (3) of a substantially non-adhesive material up to 180° C. formed from an aqueous-pasty substance which contains finely dispersed plastics which are not adhesive up to 180° C., mineral fillers or mixtures thereof.

13. Process of manufacture of a top cloth as defined in claim 12, the further step of forming the cover layer from a plastic share of thermoplast or duroplast.

14. Process of manufacture of a top cloth as defined in claim 13, the further step of forming the covering layer (3) from a dispersion; of: finely-dispersed plastic; water-soluble thickeners from the group consisting of salts of polymer acrylic acids, starch, carboxylmethylcellulose, hydroxyethylcellulose and gelatine; fatty acids or their salts; and cross-linkable silicons.

15. Process of manufacture of a top cloth as defined in claim 13, the step of forming the covering layer wherein the aqeous-pasty substance contains powdery silicic acid, talcum powder, calcium carbonate powder or the like.

16. The process of claim 1 further characterized by the base layer consisting of a brittle and porous material to enable detachment of its intermediate areas.

17. The process of claim 6 further characterized by the base layer consisting of a brittle and porous material to enable detachment of its intermediate areas.

* * * * *